US008974172B2

(12) United States Patent
Nishi

(10) Patent No.: US 8,974,172 B2
(45) Date of Patent: Mar. 10, 2015

(54) BOOM ASSEMBLY

(75) Inventor: Ryoichi Nishi, Sakai (JP)

(73) Assignee: Kubota Corporation, Osaka (JP)

( * ) Notice: Subject to any disclaimer, the term of this patent is extended or adjusted under 35 U.S.C. 154(b) by 331 days.

(21) Appl. No.: 13/419,844

(22) Filed: Mar. 14, 2012

(65) Prior Publication Data

US 2013/0017049 A1 Jan. 17, 2013

(30) Foreign Application Priority Data

Jul. 12, 2011 (JP) ..... 2011-153842

(51) Int. Cl.

| | |
|---|---|
| ***E02F 3/00*** | (2006.01) |
| ***E02F 3/34*** | (2006.01) |
| ***E02F 3/627*** | (2006.01) |
| *E02F 3/38* | (2006.01) |

(52) U.S. Cl.

CPC . *E02F 3/34* (2013.01); *E02F 3/627* (2013.01); *E02F 3/38* (2013.01)

USPC ..... 414/722; 414/727

(58) Field of Classification Search

CPC ..... E02F 3/34; E02F 3/38

USPC ..... 212/347; 414/722, 727, 686

See application file for complete search history.

(56) References Cited

U.S. PATENT DOCUMENTS

| | | | | |
|---|---|---|---|---|
| 2,586,727 | A * | 2/1952 | Shaw | 144/208.3 |
| 7,520,713 | B2 | 4/2009 | Nishi et al. | |
| 2010/0143087 | A1 * | 6/2010 | Yasuda et al. | 414/722 |

FOREIGN PATENT DOCUMENTS

| | | |
|---|---|---|
| JP | 2006-336291 | 12/2006 |
| JP | 2007-262689 | 10/2007 |

OTHER PUBLICATIONS

U.S. Appl. No. 13/419,829 to Kosuke Oyama et al., filed Mar. 14, 2012.

Japan Office action in JP 2011-153842, mail date is Feb. 25, 2014.

* cited by examiner

*Primary Examiner* — Saul Rodriguez

*Assistant Examiner* — Ronald Jarrett

(74) *Attorney, Agent, or Firm* — Greenblum & Bernstein, P.L.C.

(57) ABSTRACT

A boom has a central connection plate attached between a pair of side plates, and a rear portion side of a cover plate on a front boom portion and a front portion side of a cover plate on a rear boom portion are connected thereby. A pivoting support for a working tool cylinder used to move a working tool connected to a foremost portion of the front boom portion is provided on a front side of a top portion on each of the left and right side plates. The central connection plate is formed with a connection plate projection projecting from a front portion attached to the rear portion of the cover plate toward a midway portion so as to approach the pivoting support.

20 Claims, 4 Drawing Sheets

BOOM ASSEMBLY

CROSS-REFERENCE TO RELATED APPLICATIONS

The present application claims priority under 35 U.S.C. §119 of Japanese Application No. 2011-153842, filed on Jul. 12, 2011, the disclosure of which is expressly incorporated by reference herein in its entirety.

BACKGROUND OF THE INVENTION

1. Field of the Invention

The present invention relates to a boom assembly in a working vehicle, such as a front loader.

2. Description of Related Art

In a boom assembly of a front loader, for example, a front boom portion and a rear boom portion are curved at a center portion in a boom's length direction and are connected in a bowed shape protruding on an upper side. A left-right pair of side plates is fixedly positioned on both a left and right side of a rear portion side of the front boom portion and a front portion side of the rear boom portion. A central connection plate is attached between the pair of side plates, and a rear portion side of a cover plate on the front boom portion and a front portion side of a cover plate on the rear boom portion are connected thereby. A pivoting support for a working tool cylinder used to move a working tool connected to a foremost portion of a front boom assembly body is provided on a front side of a top portion on each of the left and right side plates.

In this type of boom assembly, in order to increase the strength in the area around the pivoting support for a working tool cylinder where stress is concentrated during excavation work and the like, it is possible to add a reinforcement plate to the area around the pivoting support. However, this negatively affects the appearance of the working vehicle. In a conventional boom assembly, the left and right side plates enable inclusion of the pivoting support for the working tool cylinder, and the thickness of the side plates is increased in an attempt to ensure strength and improve an external appearance (see, for example, Related Art 1).

[Related Art 1] Japanese Patent Laid-open Publication No. 2007-262689

SUMMARY OF THE INVENTION

Accordingly, due to the left and right side plates being thick in the conventional method, costs have increased and the weight of the boom assembly has increased. In view of the above circumstances, the present invention has as its advantage to provide a boom assembly capable of ensuring strength in the area around the pivoting support for the working tool cylinder and, moreover, to reduce costs and weight.

In order to achieve the advantage of the present invention, bow-shaped booms 27 are each composed of a rear boom portion 27B and a front boom portion 27A, the rear boom portion 27B extending horizontally from a vehicle body and the front boom portion 27A extending downward at a central portion of the boom 27 when a working tool 28 is positioned in contact with the ground. The front boom portion 27A and the rear boom portion 27B are configured from cover plates 62*a* and 62*b*, and from left and right lateral plates 61*a* and 61*b*. The left and right lateral plates 61*a* of the front boom portion 27A and the left and right lateral plates 61*b* of the rear boom portion 27B are each connected by a pair of side plates 58 having a boom cylinder pivoting support 70 and a working tool cylinder pivoting support 71. In addition, the cover plate 62*a* of the front boom portion 27A, the cover plate 62*b* of the rear boom portion 27B, and the side plates 58 are integrally connected by a central connection plate 57 positioned between the left-right pair of side plates 58. The central connection plate 57 is formed with a connection plate projection 84 projecting from a front portion attached to the rear portion of the cover plate 62*a* of the front boom portion 27A toward a midway portion so as to approach the working tool pivoting support 71.

The connection plate projection 84 is formed to project in a peaked shape so as to vertically overlap behind the pivoting support 71 in a state where the booms 27 are lowered and the working tool 28 is in contact with the ground. The central connection plate 57 includes a front attachment portion 75, a front inclined portion 77, a rear inclined portion 78, an extended projection portion 80, and a rear attachment portion 81. The front attachment portion 75 overlaps with and is attached to the rear portion of the cover plate 62*a*. The front inclined portion 77 curves upward from the front attachment portion 75 and inclines in a projection so as to approach the pivoting support 71 at a distance from the rear portion side of the cover plate 62*a* of the front boom portion 27A. The rear inclined portion 78 inclines downward from the projecting end portion of the front inclined portion 77. The extended projection portion 80 projects by extending to the rear from the lower end portion of the rear inclined portion 78. The rear attachment portion 81 projects to the rear from the extended projection portion 80 and overlaps with and is attached to the front portion of the cover plate 62*b* of the rear boom portion 27B. The connection plate projection 84 is configured from the front inclined portion 77 and the rear inclined portion 78.

Strength in an area around boss portions of the pivoting support 71 for the working tool cylinder can be effectively increased by the connection plate projection 84. Thus, in addition to ensuring adequate strength in the area around the pivoting support 71, it becomes possible to form the left and right side plates 58 with a thin plate thickness. In this regard, it becomes possible to achieve a reduction in costs, and the booms 27 may be made cheaper and lighter. During excavation work and the like in which the booms 27 are lowered and the working tool is in contact with the ground, and for which there is a risk of putting the greatest stress on an area around the pivoting support 71 for the working tool cylinder, the connection plate projection 84 is overlapped from behind on the pivoting support 71 for the working tool cylinder, and thus the area around the pivoting support 71 for the working tool cylinder can be extremely effectively reinforced with the connection plate projection 84 and the strength in the area around the pivoting support 71 for the working tool cylinder can be yet further improved.

The central connection plate 57 has the front attachment portion 75, the front inclined portion 77, the rear inclined portion 78, the extended projection portion 80, and the rear attachment portion 81, and thus rigidity of the connection portions on the rear portion side of the front boom portion 27A and the front portion side of the rear boom portion 27B can be increased. In addition, there is no need for the rear portion side of the front boom portion 27A and the front portion side of the rear boom portion 27B to be formed to be bulky, nor for the central connection plate 57, the side plates 58, and the like to be formed to be bulky. In this regard as well, structural materials for the boom assembly can be conserved and the boom assembly may be manufactured at a low cost.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
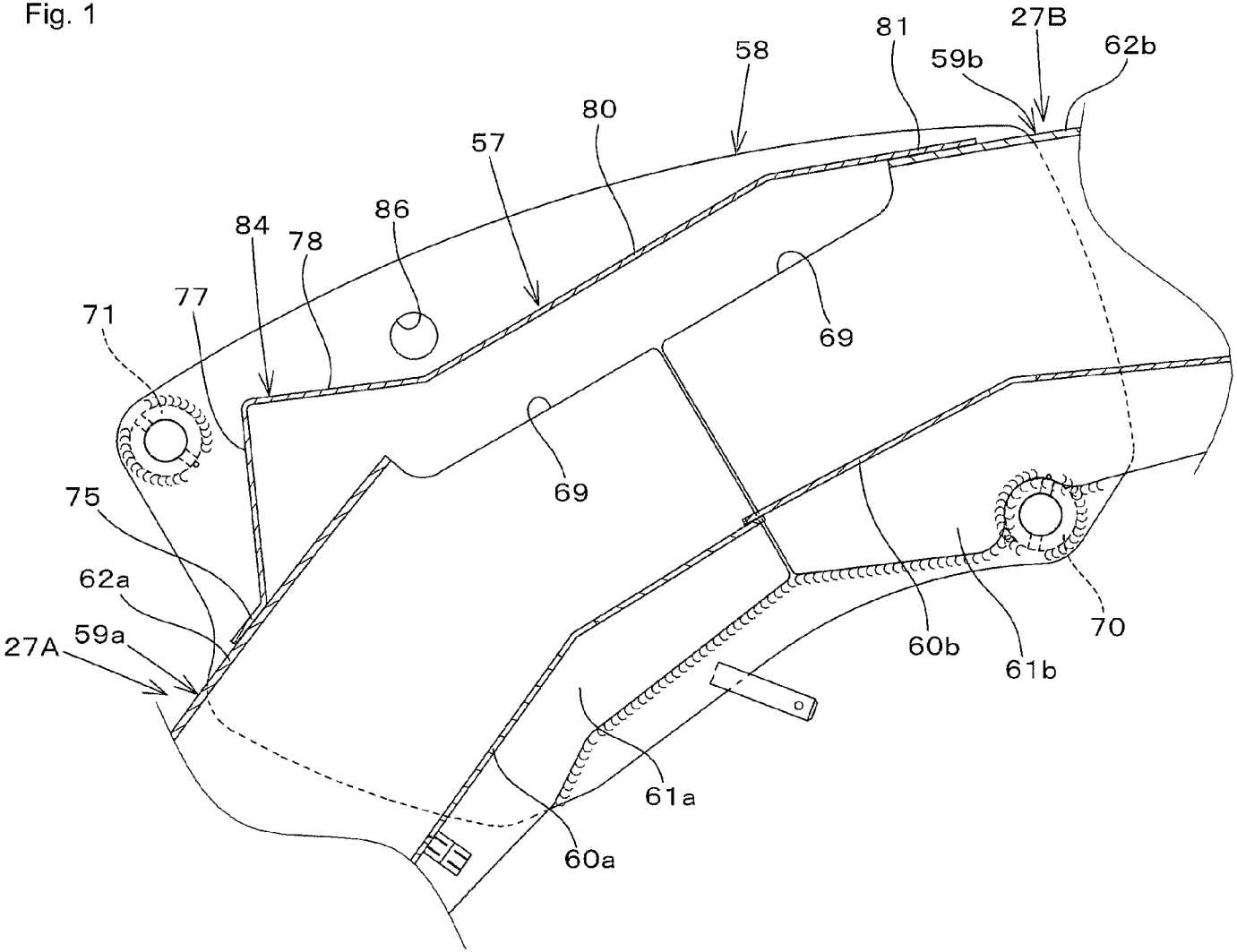
FIG. 1 is a lateral cross-sectional view of a central portion of a boom assembly according to an embodiment of the present invention.
Figure 2:
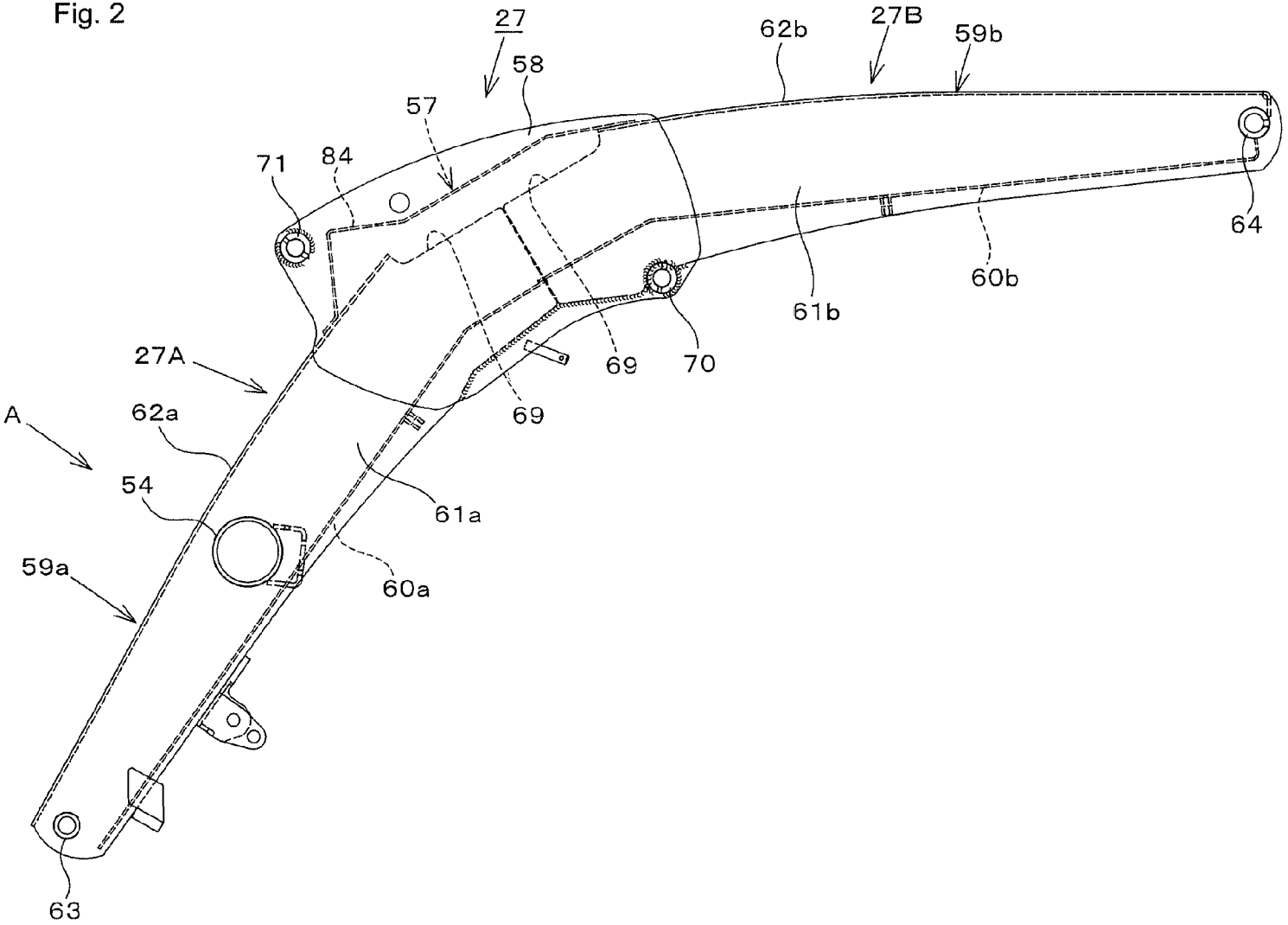
FIG. 2 is a lateral view of the boom assembly.
Figure 3:
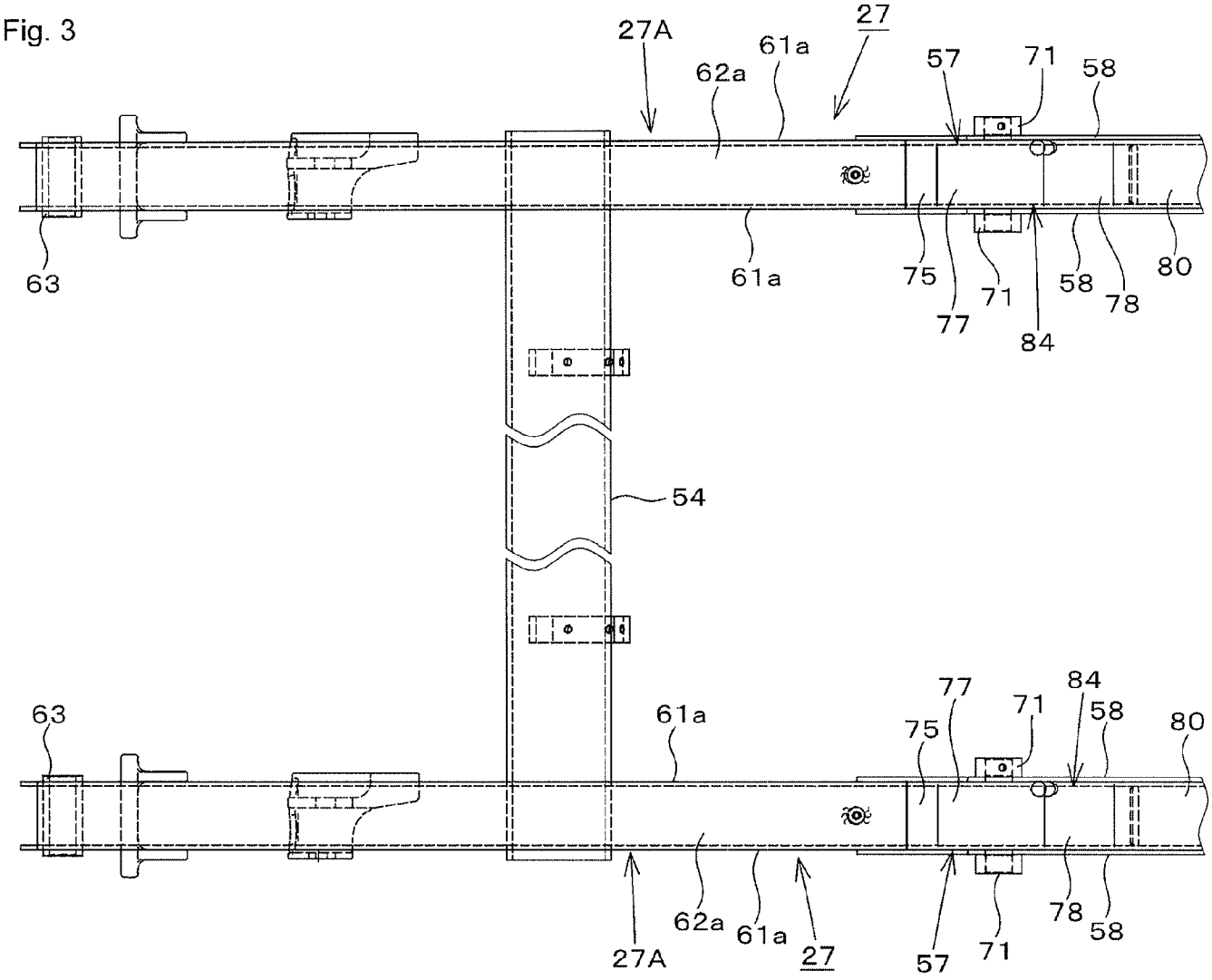
FIG. 3 is a view of the same from the perspective of an arrow A in FIG. 2.
Figure 4:
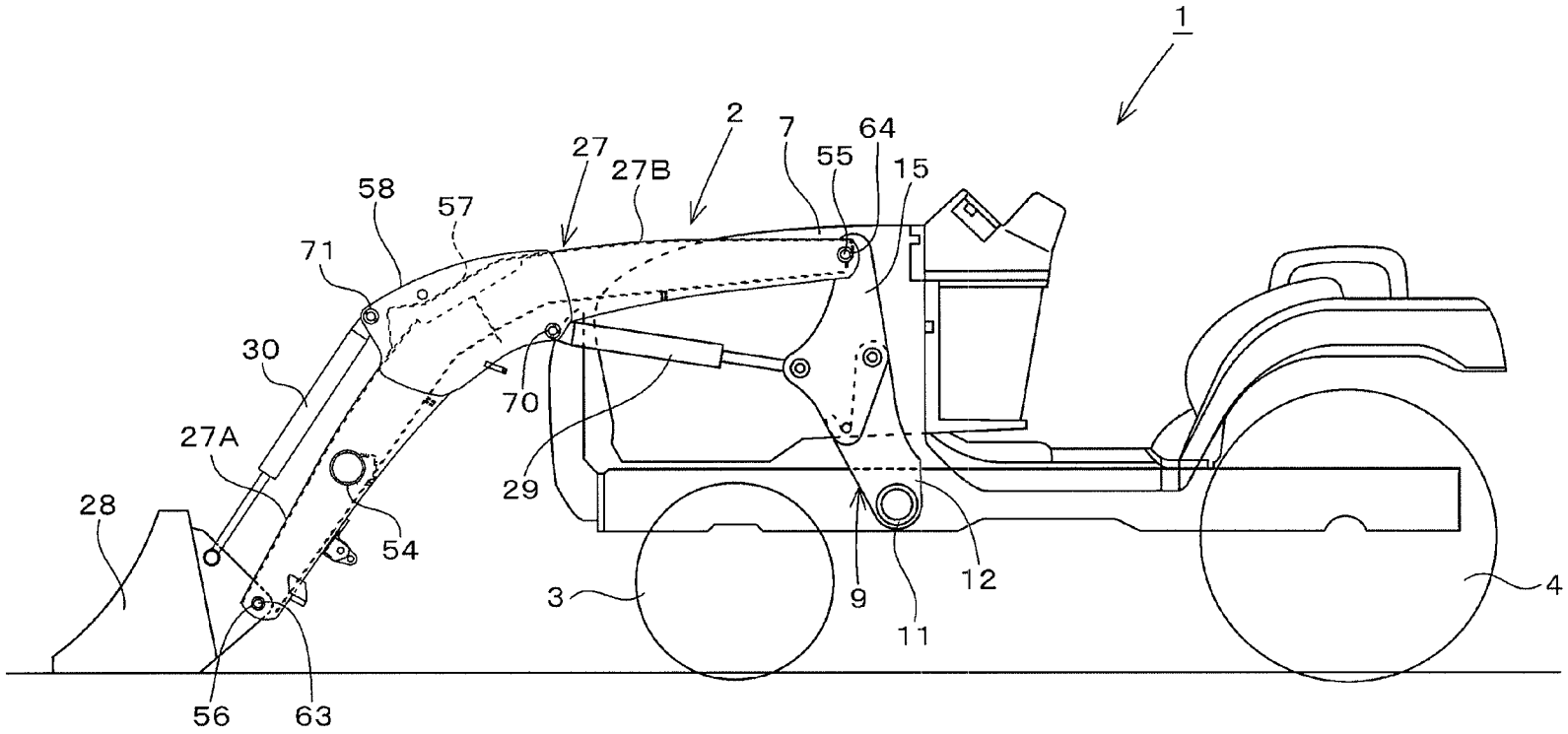
FIG. 4 is a lateral view of a tractor with a front loader mounted thereto.

Hereinafter, exemplary embodiments of the present invention are described with reference to the drawings. In FIG. 4, 1 is a tractor (moving vehicle) and 2 is a front loader (loader) detachably mounted to a front portion of the tractor 1. The tractor 1 includes a left-right pair of front wheels 3 and a left-right pair of rear wheels 4, and further includes a hood 7 in the front portion covering an engine, a radiator, and the like.

A loader attachment frame 9 is included on the tractor 1 for detachably mounting the front loader 2. The loader attachment frame 9 is provided with one left-right pair each of support platforms 11 provided so as to project outward in left and right directions from the vehicle body side of the tractor 1, and main frames 12 provided upright on the support platforms 11.

The front loader 2 includes one left-right pair each of side frames 15, the booms 27, boom cylinders 29, and bucket (working tool) cylinders 30. The front loader 2 further includes a single bucket (working tool) 28, and the left and right side frames 15 are detachably attached to the left and right main frames 12, respectively. In FIGS. 1-4, a pair of the left and right booms 27 is included positioned on both the left and right sides of the hood 7. The left and right booms 27 are mutually connected at the front portion side thereof by a connecting member 54 having a tubular shape and the like.

Each of the left and right booms 27 is supported by and connected at the base end side (rear end side) thereof by a pivot 55 so as to be rotatable about a left-right directional axis on the upper portion of the side frame 15. The booms 27 are thus vertically swingable. The left-right pair of boom cylinders 29 formed from double-action hydraulic cylinders is mounted spanning a midway portion in a length direction of each of the left and right booms 27 and a midway portion in a vertical direction of each of the left and right side frames 15. The left and right booms 27 are vertically swingable through the expansion and contraction of the left and right boom cylinders 29.

A foremost end (front end) of each of the left and right booms 27 is supported by and connected to a lower portion on the back face of the bucket (working tool) 28 via a pivot 56. The left-right pair of bucket cylinders (working tool cylinders) 30 formed from double-action hydraulic cylinders is mounted between the back surface of the bucket 28 and left and right side plates 58 which will be discussed hereafter. The bucket 28 is swingable (capable of scooping/dumping motions) through the expansion and contraction of the bucket cylinders 30.

Each of the left and right booms 27 is formed in a bowed shape curving at a central portion in the boom length direction and protruding on an upper side. In addition, each of the left and right booms 27 is formed such that the vertical width becomes gradually broader toward a central portion in the length direction from front and rear end portions. The booms 27 are each primarily configured from the front boom portion 27A on the front side of the central portion in the length direction, the rear boom portion 27B on the rear side of the central portion in the length direction, the central connection plate 57 connecting the front boom portion 27A and the rear boom portion 27B at the center in the length direction of each of the booms 27, and the side plates 58 positioned on both the left and right sides of the center in the length direction of each of the booms 27.

The front boom portion 27A is configured from a main body 59*a* and a bottom plate 60*a*, and the rear boom portion 27B is configured from a main body 59*b* and a bottom plate 60*b*. The main body 59*a* and the main body 59*b* are formed with roughly the same shape and the bottom plate 60*a* and the bottom plate 60*b* have roughly the same shape. Components may thus be made multipurpose. The main body 59*a* of the front boom portion 27A has a squared U shape in cross-section having an open bottom formed by the left-right pair of lateral plates 61*a* and the cover plate 62*a* connecting the upper end portions of the left and right lateral plates 61*a*. The main body 59*b* of the rear boom portion 27B has a squared U shape in cross-section having an open bottom formed by the left-right pair of lateral plates 61*b* and the cover plate 62*b* connecting the upper end portions of the left and right lateral plates 61*b*. The main body 59*a* and the main body 59*b* have a curved shape with a marked upward protrusion as viewed from the side.

The front and rear main bodies 59*a* and 59*b* are formed by flexion of a single plate member to have a squared U shape in cross-section and, after the bending work into a squared U shape, the front and rear main bodies 59*a* and 59*b* are worked through bending into a curved shape with an upward protrusion. The front boom portion 27A and the rear boom portion 27B are positioned inverted front to back so as to form a front-back symmetrical shape. The front boom portion 27A and the rear boom portion 27B are connected by the central connection plate 57. A pivoting support 63 is provided at the front end side of the front boom portion 27A, the pivoting support 63 formed by a tubular body penetrating the left and right lateral plates 61*a* and running therebetween, and additionally fixed thereto by welding. The bucket 28 is supported by and rotatably connected to the pivoting support 63 by the pivot 56.

A pivoting support 64 is provided at the rear end side of the rear boom portion 27B, the pivoting support 64 being formed by a tubular body penetrating the left and right lateral plates 61*b* and running therebetween and additionally fixed thereto by welding. The pivoting support 64 is pivotingly supported on the side frames 15 by the pivot 55 and the booms 27 are connected to the side frames 15 so as to be vertically rotatable. The front and rear bottom plates 60*a* and 60*b* are configured from flat plates, and are disposed below the cover plates 62*a* and 62*b* and between the right and left lateral plates 61*a* and 61*b*. After the bending work on the main bodies 59*a* and 59*b*, the left and right side edge portions of the bottom plates 60*a* and 60*b* are fixed by welding to an inner surface of the left and right lateral plates 61*a* and 61*b*, respectively. The rear end portion of the bottom plate 60*a* and the front end portion of the bottom plate 60*b* are vertically overlaid and welded to one another.

In order to facilitate insertion of a welding torch between the lateral plates 61*a* and 61*b* at the center in the length direction of the booms 27 when welding the bottom plates 60*a* and 60*b* to the lateral plates 61*a* and 61*b*, a cutaway 69 is formed on the front and rear main bodies 59*a* and 59*b* on an upper portion side at the center in the length direction of the booms 27. The bottom plates 60*a* and 60*b* are welded from below to the lateral plates 61*a* and 61*b*, beginning at each front and rear end portion side of the booms 27 and running to the midway portion in the length direction of the booms 27. The bottom plates 60*a* and 60*b* are welded from above to the lateral plates 61*a* and 61*b* at the center in the length direction of the booms 27.

After the bottom plates 60*a* and 60*b* have been fixed by welding to the front and rear main bodies 59*a* and 59*b*, respectively, the bottom plates 60*a* and 60*b* are matched up at the center in the length direction of the booms 27. The front and rear bottom plates 60*a* and 60*b* are welded to one another. In addition, the central connection plate 57 and the left and right side plates 58 are welded to the front and rear boom portions 27A and 27B and are thereby connected to one another. The central connection plate 57 and the left and right side plates 58 are welded together and are thereby connected.

The left and right side plates 58 are provided so as to span the front and rear lateral plates 61*a* and 61*b* at the center in the length direction of the booms 27, and are fixedly positioned on both the left and right sides of the rear end side of the front boom portion 27A and the front end side of the rear boom portion 27B. The cylinder pivoting support 70 for the boom cylinder is provided at a rear side of a lower end portion of each of the left and right side plates 58. The cylinder pivoting support 70 has pivoting support bosses welded to the exterior surfaces of each of the left and right side plates 58.

The cylinder pivoting support 71 for the working tool cylinder is provided on a front side of the upper end portion of each of the left and right side plates 58. The cylinder pivoting support 71 is positioned at a distance from the front boom portion 27A such that the cylinder pivoting support 71 is positioned above the rear portion side of the cover plate 62*a* of the front boom portion 27A in a state where the booms 27 are lowered and the working tool 28 is in contact with the ground (the state shown in FIG. 4). Pivoting support bosses are then welded to the exterior surfaces of each of the right and left side plates 58.

The pair of bucket cylinders 30 correspond to the pair of left and right booms 27 and are disposed directly thereabove. Each of the bucket cylinders 30 is disposed above and along the line of each of the front boom portions 27A. The pair of boom cylinders 29 corresponds to the pair of left and right booms 27 and is positioned directly therebelow, each of the boom cylinders 29 being disposed below each of the rear boom portions 27B. The front end portions of the boom cylinders 29 are supported by and connected to the cylinder pivoting supports 70 for the boom cylinders, and the rear end portions of the bucket cylinders 30 are supported by and connected to the cylinder pivoting supports 71 for the bucket cylinder.

The central connection plate 57 is formed by bending a flat plate. The central connection plate 57 is then provided spanning the front and rear cover plates 62*a* and 62*b*, and is then attached between the pair of side plates 58 by welding. In addition, the central connection plate 57 is connected to the rear portion side of the cover plate 62*a* of the front boom portion 27A and to the front portion side of the cover plate 62*b* of the rear boom portion 27B by welding. The central connection plate 57 includes the front attachment portion 75, the front inclined portion 77, the rear inclined portion 78, the extended projection portion 80, and the rear attachment portion 81. The front attachment portion 75 overlaps with and is attached to the rear portion of the cover plate 62*a* of the front boom portion 27A. The front inclined portion 77 curves upward from the front attachment portion 75 and inclines in a projection so as to approach the pivoting support 71 at a distance from the rear portion side of the cover plate 62*a* of the front boom portion 27A. The rear inclined portion 78 inclines downward from the projecting end portion of the front inclined portion 77. The extended projection portion 80 projects by extending to the rear from the lower end portion of the rear inclined portion 78. The rear attachment portion 81 projects to the rear from the extended projection portion 80 and overlaps with and is attached to the front portion of the cover plate 62*b* of the rear boom portion 27B. The central connection plate 57 is disposed to be internally between the left and right side plates 58 along the entire length thereof. Aside from the front attachment portion 75 and the rear attachment portion 81, the front inclined portion 77, the rear inclined portion 78, and the extended projection portion 80 connect the left and right side plates 58 at a position distant vertically from the rear portion side of the cover plate 62*a* and the front portion side of the cover plate 62*b*.

The connection plate projection 84 is formed on the central connection plate 57, the connection plate projection 84 projecting from the front portion attached to the rear portion of the cover plate 62*a* of the front boom portion 27A toward a midway portion so as to approach the pivoting support 71. The connection plate projection 84 is configured from the front inclined portion 77 and the rear inclined portion 78 and is formed to project in a peaked shape so as to vertically overlap behind the pivoting support 71 in a state where the booms 27 are lowered and the working tool 28 is in contact with the ground.

Then, both left and right ends of each of the front attachment portion 75, the front inclined portion 77, the rear inclined portion 78, the extending projection portion 80, and the rear attachment portion 81 of the central connection plate 57 are welded to an upper portion-side inner surface of the right and left side plates 58. The front attachment portion 75 is welded to the rear portion of the cover plate 62*a* of the front boom portion 27A. The rear attachment portion 81 is welded to the front portion of the cover plate 62*b* of the rear boom portion 27B. Furthermore, a hook hole 86 is provided behind the pivoting support 71 on the left and right side plates 58.

According to the above embodiment, the connection plate projection 84 is formed on the central connection plate 57, the connection plate projection 84 projecting from the front portion attached to the rear portion of the cover plate 62*a* of the front boom portion 27A toward a midway portion so as to approach the pivoting support 71. Therefore, the strength in the area around the pivoting support 71 for the working tool cylinder can be effectively increased by the connection plate projection 84. Thus, in addition to ensuring adequate strength in the area around the pivoting support 71, it becomes possible to form the left and right side plates 58 with a thin plate thickness (for example, it becomes possible to modify a side plate having a plate thickness of 6.4 mm to 4.6 mm). In this regard, it becomes possible to achieve a reduction in costs (cost reduction of approximately 30%, for example) and the booms 27 can be made cheaper and lighter. Moreover, the central connection plate 57, inclusive of the connection plate projection 84, is between the left and right side plates 58 and so is difficult to see from the exterior. Thus, there is no longer any negative effect on exterior appearance due to the form of the connection plate projection 84 and the exterior appearance of the booms 27 improves.

In addition, the connection plate projection 84 is formed to project in a peaked shape so as to vertically overlap behind the pivoting support 71 in a state where the booms 27 are lowered and the working tool 28 is in contact with the ground. Therefore, during excavation work and the like in which the booms 27 are lowered and the working tool 28 is in contact with the ground, and for which there is a risk of putting the greatest stress on an area around the pivoting support 71 for the working tool cylinder, the connection plate projection 84 is overlapped from behind on the boss portions of the pivoting support 71 for the working tool cylinder, and thus the area around the pivoting support 71 for the working tool cylinder may be extremely effectively reinforced with the connection plate projection 84 and the strength in the area around the pivoting support 71 for the working tool cylinder can be yet further improved.

Moreover, the central connection plate 57 has the front attachment portion 75, the front inclined portion 77, the rear inclined portion 78, the extended projection portion 80, and the rear attachment portion 81, and thus rigidity of the connection portions on the rear portion side of the front boom portion 27A and the front portion side of the rear boom portion 27B may be increased. In addition, there is no longer any need for the rear portion side of the front boom portion 27A and the front portion side of the rear boom portion 27B to be formed to be bulky, nor for the central connection plate 57, the side plates 58, and the like to be formed to be bulky. In this regard as well, it becomes possible to make the booms 27 cheaper and lighter.

Furthermore, when the central connection plate 57 is attached to the rear portion side of the cover plate 62*a* of the front boom portion 27A and to the front portion side of the cover plate 62*b* of the rear boom portion 27B, the position of the central connection plate 57 may be easily displaced forward and backward relative to the rear portion side of the cover plate 62*a* and the front portion side of the cover plate 62*b*, and can be easily attached to the rear portion side of the cover plate 62*a* and the front portion side of the cover plate 62*b*. In addition, the connection plate projection 84 may be attached as closely as possible behind the pivoting support 71 for the working tool cylinder, leaving the smallest gap necessary. Thereby, a reinforcement effect of the connection plate projection 84 on the area around the pivoting support 71 can be increased.

According to the above embodiment, the connection plate projection 84 is formed to project in a peaked shape so as to vertically overlap behind the pivoting support 71 in a state where the booms 27 are lowered and the working tool 28 is in contact with the ground. However, instead, the connection plate projection 84 may be formed to project so as to approach the pivoting support 71 from below in a state where the booms 27 are lowered and the working tool 28 is in contact with the ground.

The connection plate projection 84 is not limited to projecting in a peaked shape and may also project in a trapezoidal shape or a quadrangular shape.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A boom assembly having a rounded shape curved at a center in the length direction so as to protrude on an upper side from a lateral view, the boom assembly comprising:

a boom having a rear boom portion and a front boom portion, the rear boom portion extending horizontally from a vehicle body and the front boom portion extending downward from a central portion of the boom when a working tool attached to a foremost end of the boom is positioned in contact with the ground, wherein the front boom portion and the rear boom portion are configured from integral cover plates and from left and right lateral plates, the upper surfaces of the front boom portion and the rear boom portion are formed with a curved surface in the length direction, and lower portions of the left and right lateral plates are connected by bottom plates; and rear portions of the left and right lateral plates of the front boom portion and front portions of the left and right lateral plates of the rear boom portion are connected by a pair of side plates having a boom cylinder pivoting support and a working tool cylinder pivoting support, and the cover plate of the front boom portion, the cover plate of the rear boom portion, and the side plates are integrally connected by a central connection plate positioned between the pair of side plates, wherein the central connection plate is formed with a connection plate projection projecting from a front portion attached to a rear portion of the cover plate of the front boom portion toward a midway portion so as to approach the working tool pivoting support.

2. The boom assembly according to claim 1, wherein the connection plate projection is formed to project in a peaked shape so as to vertically overlap behind the working tool cylinder pivoting support in a state where the boom is lowered and the working tool is in contact with the ground.

3. The boom assembly according to claim 2, wherein the central connection plate comprises:

a front attachment portion overlapping with and attached to the rear portion of the cover plate of the front boom portion;

a front inclined portion curving upward from the front attachment portion and inclining by projecting so as to approach the working tool cylinder pivoting support at a distance from the rear portion side of the cover plate;

a rear inclined portion inclining downward from the projecting end portion of the front inclined portion;

an extended projection portion projecting by extending to the rear from the lower end portion of the rear inclined portion; and a rear attachment portion projecting to the rear from the extended projection portion and overlapping with and attached to the front portion of the cover plate of the rear boom portion; and wherein the connection plate projection is configured from the front inclined portion and the rear inclined portion.

4. The boom assembly according to claim 1, wherein the central connection plate overlaps portions of the front and rear boom portions.

5. The boom assembly according to claim 1, wherein the central connection plate further comprises:

a rear attachment portion attached to a front portion of the rear boom portion.

6. The boom assembly according to claim 5, wherein the connection plate projection of the central connection plate is closer to the front portion attached to a rear portion of the cover plate of the front boom portion than to the rear attachment portion of the central connection plate.

7. The boom assembly according to claim 1, wherein the boom assembly is arranged on a front loader tractor.

8. A boom assembly curved at a center in the length direction so as to protrude on an upper side from a lateral view, the boom assembly comprising:

a boom having a rear boom portion and a front boom portion, the rear boom portion extending horizontally from a vehicle body and the front boom portion extending downward at a central portion of the boom when a working tool attached to a foremost end of the boom is positioned in contact with the ground, wherein the front boom portion and the rear boom portion have a squared U shape in cross-section configured from cover plates and left and right lateral plates, and lower portions of the left and right lateral plates are connected by bottom plates; and rear portions of the left and right lateral plates of the front boom portion and front portions of the left and right lateral plates of the rear boom portion are connected by a pair of side plates having a boom cylinder pivoting support and a working tool cylinder pivoting support, and the cover plate of the front boom portion, the cover plate of the rear boom portion, and the side plates are integrally connected by a central connection plate positioned between the pair of side plates, wherein the central connection plate is formed with a connection plate projection projecting from a front portion attached to a rear portion of the cover plate of the front boom portion toward a midway portion so as to approach the working tool pivoting support.

9. The boom assembly according to claim 8, wherein the connection plate projection is formed to project in a peaked shape so as to vertically overlap behind the working tool cylinder pivoting support in a state where the booms are lowered and the working tool is in contact with the ground.

10. The boom assembly according to claim 9, wherein the central connection plate comprises:

a front attachment portion overlapping with and attached to the rear portion of the cover plate of the front boom portion;

a front inclined portion curving upward from the front attachment portion and inclining by projecting so as to approach the working tool cylinder pivoting support at a distance from the rear portion side of the cover plate;

a rear inclined portion inclining downward from the projecting end portion of the front inclined portion;

an extended projection portion projecting by extending to the rear from the lower end portion of the rear inclined portion; and a rear attachment portion projecting to the rear from the extended projection portion and overlapping with and attached to the front portion of the cover plate of the rear boom portion; and wherein the connection plate projection is configured from the front inclined portion and the rear inclined portion.

11. The boom assembly according to claim 8, wherein the central connection plate overlaps portions of the front and rear boom portions.

12. The boom assembly according to claim 8, wherein the central connection plate further comprises:

four bends with three of said four bends forming the connection plate projection; and a rear attachment portion attached to a front portion of the rear boom portion.

13. The boom assembly according to claim 12, wherein the connection plate projection of the central connection plate is closer to the front portion attached to the rear portion of the cover plate of the front boom portion than to the rear attachment portion of the central connection plate.

14. The boom assembly according to claim 8, wherein the boom assembly is arranged on a front loader tractor.

15. A left and right pair of boom assemblies curved at a center in the length direction so as to protrude on an upper side from a lateral view, the boom assemblies comprising:

a pair of booms, each having a rear boom portion and a front boom portion, the rear boom portion extending horizontally from a vehicle body and the front boom portion extending downward at a central portion of each boom when a working tool attached to a foremost end of the booms are positioned in contact with the ground, wherein the front boom portion and the rear boom portion have a squared U shape in cross-section configured from cover plates and left and right lateral plates, the upper surfaces of the front boom portion and the rear boom portion are formed with a curved surface in the length direction, and bottom portions of the left and right lateral plates are connected by bottom plates; and rear portions of the left and right lateral plates of the front boom portion and front portions of the left and right lateral plates of the rear boom portion are connected by a pair of side plates having a boom cylinder pivoting support and a working tool cylinder pivoting support, and the cover plate of the front boom portion, the cover plate of the rear boom portion, and the side plates are integrally connected by a central connection plate positioned between the pair of side plates; and the pair of booms are connected to each other by a connecting member connecting a midway portion of the front boom portion of each boom, wherein the central connection plate is formed with a connection plate projection projecting from a front portion attached to a rear portion of the cover plate of the front boom portion toward a midway portion so as to approach the working tool pivoting support.

16. The boom assembly according to claim 15, wherein the central connection plate overlaps portions of the front and rear boom portions and the connection plate projection is arranged between the midway portion of the central connection plate and the front portion attached to the rear portion of the cover plate of the front boom portion.

17. The boom assembly according to claim 15, wherein the central connection plate further comprises:

a rear attachment portion attached to a front portion of the rear boom portion.

18. The boom assembly according to claim 17, wherein the connection plate projection of the central connection plate is closer to the front portion attached to a rear portion of the cover plate of the front boom portion than to the rear attachment portion of the central connection plate.

19. The boom assembly according to claim 15, wherein the boom assembly is arranged on a front loader tractor.

20. The boom assembly according to claim 15, wherein the connection plate projection of the central connection plate is configured to increases strength in an area around boss portions of the working tool pivoting support.

* * * * *